US007302742B2

(12) United States Patent
Pontaoe

(10) Patent No.: US 7,302,742 B2
(45) Date of Patent: Dec. 4, 2007

(54) SIDE-RELEASE BUCKLE ASSEMBLY

(75) Inventor: John S. Pontaoe, Chicago, IL (US)

(73) Assignee: Illinois Tool Works Inc, Glenview, IL (US)

( * ) Notice: Subject to any disclaimer, the term of this patent is extended or adjusted under 35 U.S.C. 154(b) by 127 days.

(21) Appl. No.: 11/351,923

(22) Filed: Feb. 10, 2006

(65) Prior Publication Data

US 2007/0017074 A1 Jan. 25, 2007

Related U.S. Application Data

(60) Provisional application No. 60/700,833, filed on Jul. 20, 2005.

(51) Int. Cl.
*A44B 11/25* (2006.01)

(52) U.S. Cl. ..... 24/614; 24/615; 24/625

(58) Field of Classification Search ..... 24/614, 24/615, 625; D11/216
See application file for complete search history.

(56) References Cited

U.S. PATENT DOCUMENTS 1,477,597 A * 12/1923 Schneider ..... 24/616
4,672,725 A 6/1987 Kasai
5,465,472 A 11/1995 Matoba
5,791,026 A * 8/1998 Anscher ..... 24/615
5,806,152 A 9/1998 Saitou et al.
6,148,486 A * 11/2000 Uehara et al. ..... 24/170
6,263,548 B1 * 7/2001 Ikeda ..... 24/625
6,571,433 B2 * 6/2003 Uehara et al. ..... 24/614
6,757,944 B2 7/2004 Buscart
2003/0196302 A1 * 10/2003 Buscart ..... 24/614
2005/0091808 A1 5/2005 Uehara et al.

FOREIGN PATENT DOCUMENTS

EP 0204250 12/1986
EP 1466537 10/2004
WO WO 9820765 5/1998

* cited by examiner

*Primary Examiner*—Robert J. Sandy
(74) *Attorney, Agent, or Firm*—Mark W. Croll; Paul F. Donovan

(57) ABSTRACT

A buckle assembly includes a female connection member having button openings, and a male connection member configured to mate with the female connection member into a securely connected position. The male connection member includes lateral arms having buttons at distal ends. The lateral arms are configured to deflect about pivot points, and the buttons are configured to be secured within the button openings. A flexible and resilient floating strut connects the lateral arms together.

17 Claims, 7 Drawing Sheets

SIDE-RELEASE BUCKLE ASSEMBLY

RELATED APPLICATIONS

This application relates to and claims priority benefits from U.S. Provisional Patent Application 60/700,833 entitled "Side Release Buckle," filed Jul. 20, 2005, which is hereby incorporated by reference in its entirety.

FIELD OF THE INVENTION

Embodiments of the present invention generally relate to a buckle assembly, and more particularly to a side-release buckle assembly.

BACKGROUND OF THE INVENTION

A conventional side-release buckle assembly includes a male connection member that is configured to mate with a female connection member, such as shown and described in U.S. Pat. No. 5,465,472, entitled "Buckle." Each connection member is configured to retain a strap, such as a seatbelt or backpack strap. The male connection member includes integral buttons that may be engaged to release the male connection member from the female connection member, thereby disconnecting the buckle assembly.

FIG. 1 illustrates a top view of a disconnected conventional buckle assembly 10. The buckle assembly 10 includes a male connection member 12 and a female connection member 14. The male connection member 12 includes a pair of flexible lateral arms 16 having buttons 18 at distal ends 20. A rigid strut member 22 extends between the lateral arms 16. A strap receiving channel 21 is formed through the male connection member 12 between the rigid strut member 22 and a strap bar 23, which is configured to clamp into a strap. The lateral arms 16 are configured to pivot in the direction of arcs A and A' about pivot points 24 defined by the union of the rigid strut member 22 and the lateral arms 16. In general, the rigid strut member 22 is disposed between the pivot points 24 and the strap-receiving channel 21. As such, the pivot points 24 are distally located from the strap bar 23. As shown in FIG. 1, the rigid strut member 22 extends between the arms 16 and is integrally connected to the main body 25 of the male connection member 12. Thus, the rigid strut member 22 is inflexible.

In order to secure the male connection member 12 into the female connection member 14, the male connection member 12 is urged into the female connection member 14 in the direction of arrow B. A guide beam 26 of the male connection member 12 moves into a reciprocal channel (not shown) formed in the female connection member 14 to ensure proper mating alignment between the male and female connection members 12 and 14, respectively. As the male connection member 12 is urged into the female connection member 14, the lateral arms 16 deflect inwardly in the directions of arcs A and A' until the buttons 18 reach button openings 28 formed through the female connection member 14. When the buttons 18 enter the button openings 28, the tension stored in the lateral arms 16 snapably forces the lateral arms 16 and the buttons laterally outward, so that the buttons 18 are secured within the button openings 28. At this point, the male connection member 12 is secured to the female connection member 14.

FIG. 2 illustrates a top view of the conventional buckle assembly 10 in which the male connection member 12 is securely mated into the female connection member 14. In order to disconnect the male connection member 12 from the female connection member 14, the buttons 18 are squeezed toward one another in the direction of arcs A and A'.

Referring to FIGS. 1 and 2, in general, the larger the lateral arms 16 are, the easier it is for a user to push the buttons 18 inward. Because of the configuration of the rigid strut member 22 and associated pivot points 24, however, the size of the arms 16 and buttons 18 is limited. Further, if the arms 16 are too large, the arms 16 are not easily deflected due to the force exerted into the arms 16 by the rigid strut member 22.

Thus, a need exists for a buckle assembly having mating components that may be easily disconnected. In particular, a need exists for a side-release buckle assembly in which a male connection member may be disconnected from a female connection member using less force as compared to conventional side-release buckle assemblies.

SUMMARY OF THE INVENTION

Certain embodiments of the present invention provide a first, or male buckle connector/male connection member, configured to securely mate with a second, or female buckle connector/female connection member. The male buckle connector includes lateral arms having buttons at distal ends. The buttons are configured to be engaged to disconnect the male buckle connector from the female buckle connector. The lateral arms are configured to deflect about first pivot points. A flexible and resilient floating strut, which may be U-, or W-shaped, connects the lateral arms together. The floating strut is configured to deflect about at least one second pivot point. The floating strut may spring-bias the lateral arms apart from one another.

The male buckle connector may also include a strap bar. The first pivot points may be proximate the strap bar. A cavity may be defined between the lateral arms, the floating strut, and the strap bar.

The floating strut may include button arms extending from the buttons. The button arms may integrally connect to inwardly-directed curved portions. The curved portions may, in turn, integrally connect to a bridge that connects the inwardly-directed curved portions together. The second pivot point(s) may be proximate the curved portions.

Figure 1:
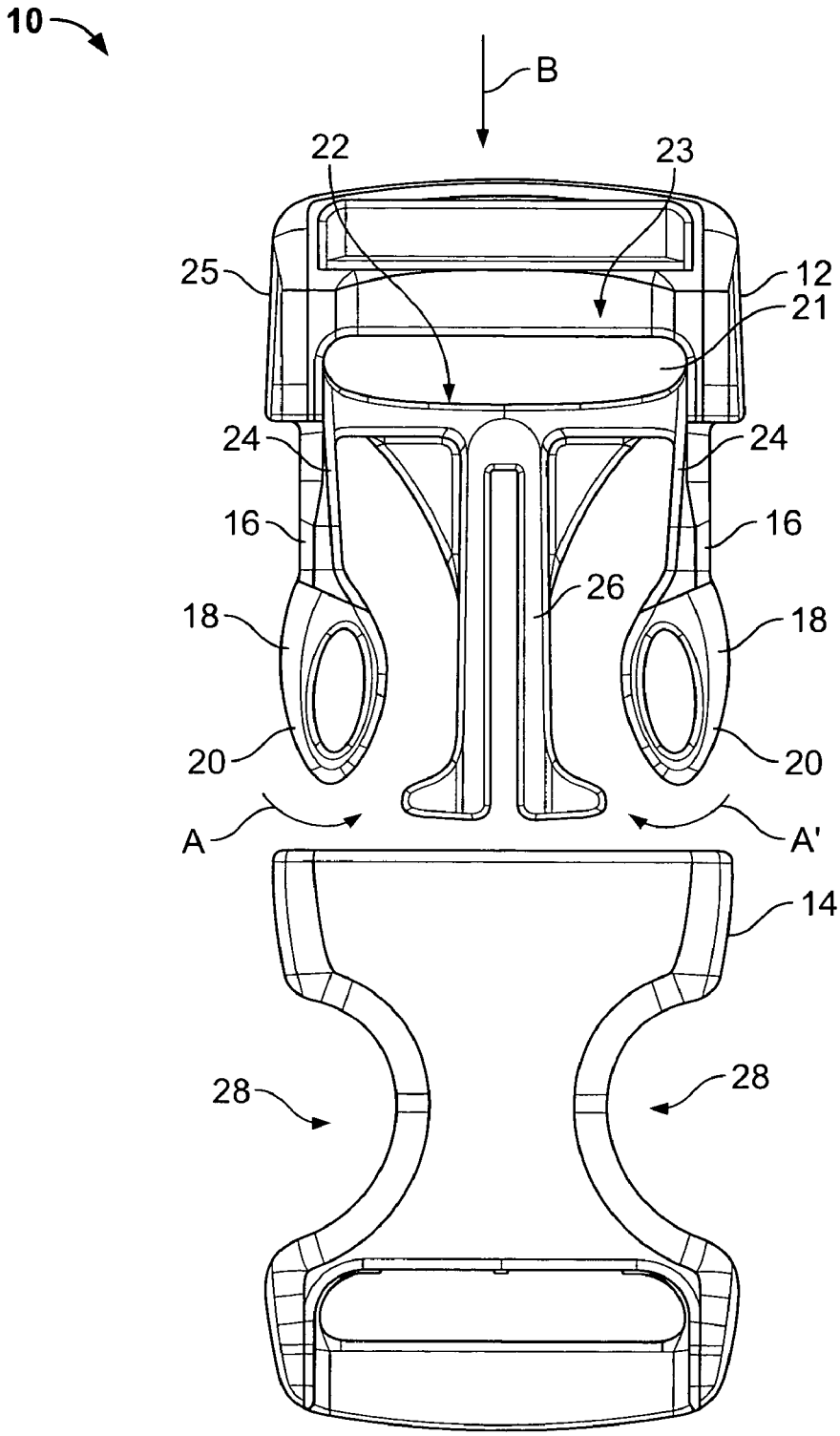
FIG. 1 (Prior Art)
FIG. 1 illustrates a top view of a disconnected conventional buckle assembly.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

Figure 3:
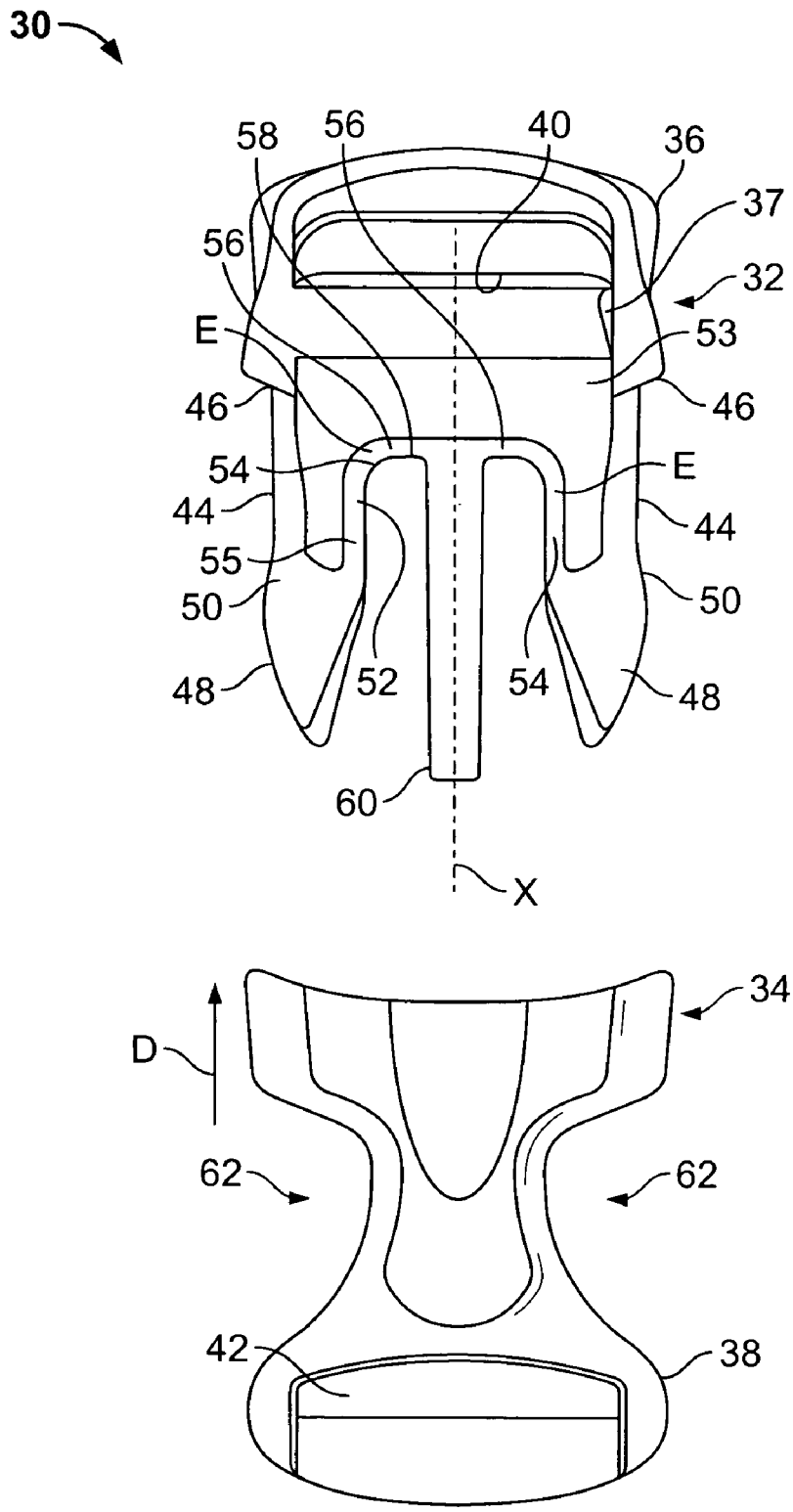
FIG. 3 illustrates a top view of a disconnected buckle assembly according to an embodiment of the present invention.
Figure 4:
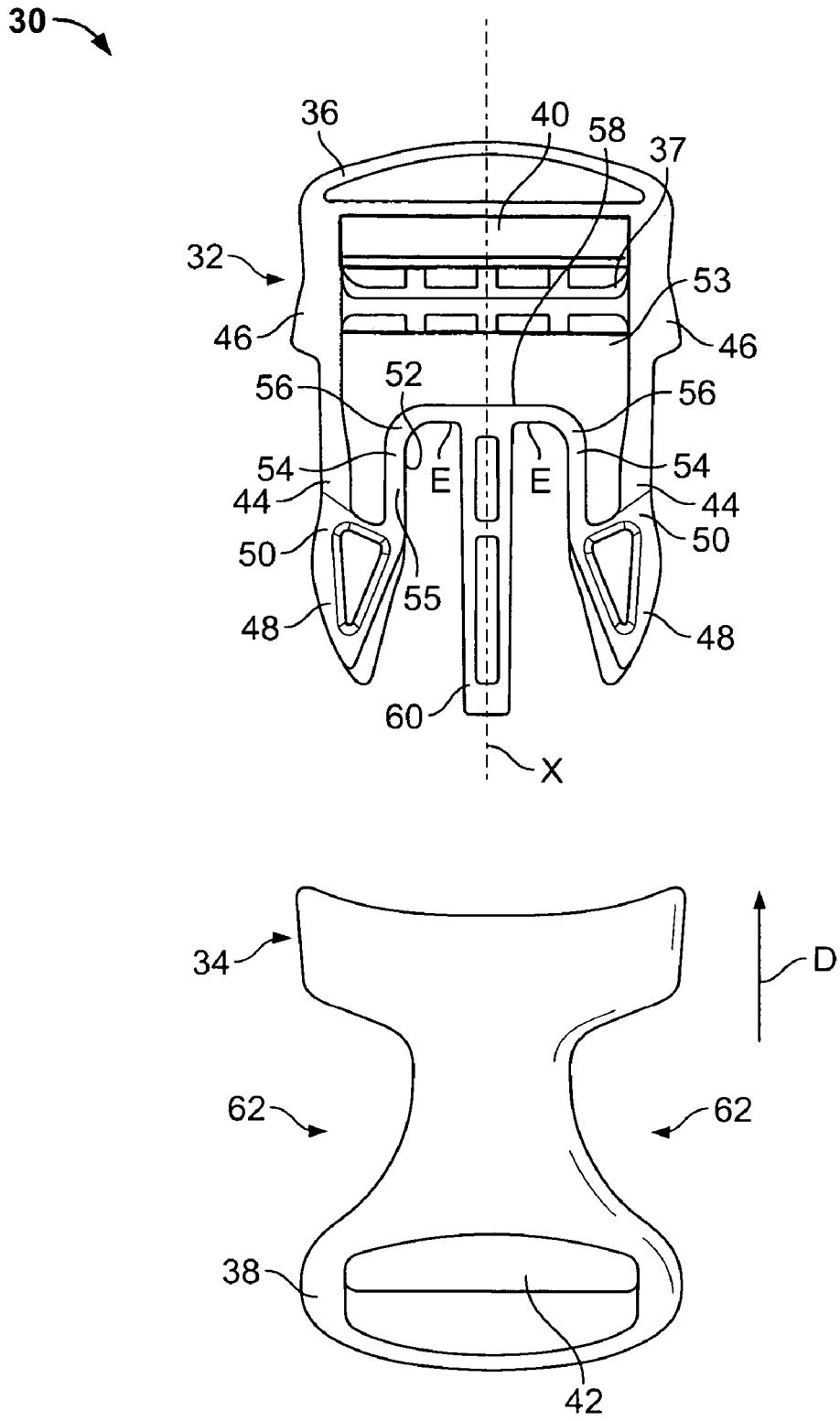
FIG. 4 illustrates a bottom view of a disconnected buckle assembly according to an embodiment of the present invention.

FIGS. 3 and 4 illustrate top and bottom views, respectively, of a disconnected buckle assembly 30 according to an embodiment of the present invention. The buckle assembly 30 includes a male connection member 32, or male buckle connector, that is configured to mate with a female connection member 34, or female buckle connector. Both the male and female connection members 32 and 34 include main bodies 36 and 38, respectively, that include strap channels 40 and 42, respectively, configured to slidably retain a strap therein.

The male connection member 32 includes lateral arms 44 integrally connected to the main body 36 proximate a strap bar 37 at pivot points 46. Buttons 48 are formed at distal ends 50 of the lateral arms 44. A floating strut 52 integrally connects the lateral arms 44. A central cavity 53 may be defined between the floating strut 52, the lateral arms 44 and the strap bar 37.

The floating strut 52 includes flexible, resilient beams 54, or spring members, having button arms 55 that extend inwardly toward the main body 36 from proximal ends of the buttons 48. The button arms 55 are integrally connected to curved portions 56 that curve inwardly toward an axial center X of the male connection member 32. The curved portions 56 are integrally formed with a bridge 58 that integrally connects the curved portions 56, and therefore the resilient beams 54 and the lateral arms 44 together. As shown in FIGS. 3 and 4, the resilient beams 54 connect together to form a U-shape. A mating guide beam 60 may outwardly extend from a central portion of the bridge 58.

When the buttons 48 are squeezed together, the lateral arms 44 pivot about the pivot points 46. Simultaneously, the resilient beams 54 pivot about points E proximate the union of the curved portions 56 and the bridge 58 such that the button arms 55 move toward one another, while the curved portions 56 and the mating guide beam 60 move inwardly toward the main body 36 in the direction of arrow D.

Figure 2:
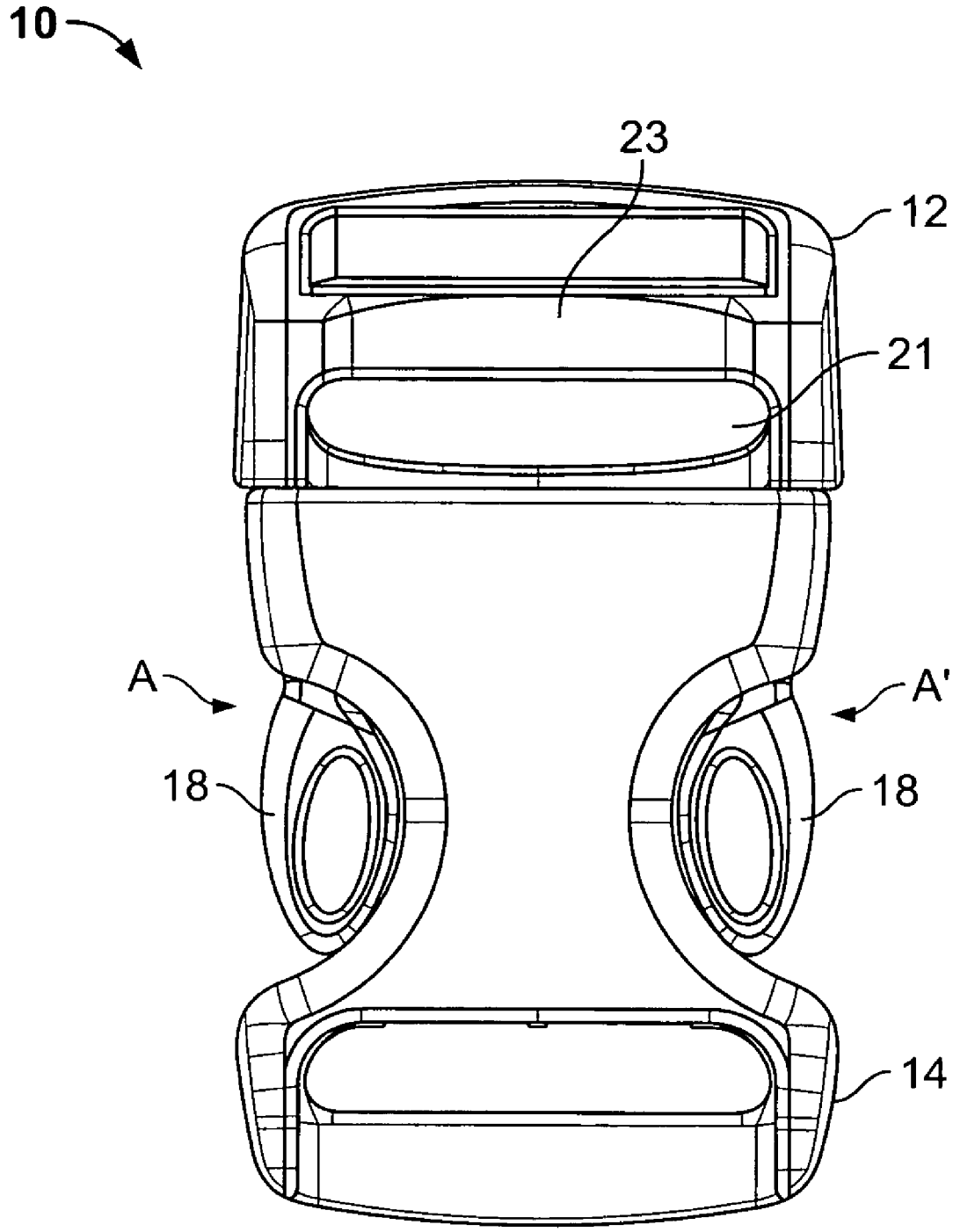
FIG. 2 (Prior Art)
FIG. 2 illustrates a top view of a conventional buckle assembly.

Because the male connection member 32 does not include a rigid strut member, such as that of the assembly 10 shown with respect to FIGS. 1 and 2, the main pivot points 46 of the lateral arms 44 are located closer to the load applied at the strap bar 37 as compared to a conventional buckle assembly. Further, because of the location of the pivot points 46, the buttons 48 may be bigger, and easier to engage, as compared with the assembly 10. The buttons 48 may be bigger because the length of the arms 44 is longer due to the location of the main pivot points 46. Further, the floating strut 52 provides increased support between the arms 44, thereby bracing the lateral arms 44 and preventing them from breaking off at the pivot points 46. Overall, the arms 44 of the male connection member 32 are longer than conventional buckle assemblies. The buttons 48 are easy to engage, and the arms 44 are easily deflected.

In order to securely mate the male connection member 32 into the female connection member 34, the male connection member 32 is urged into the female connection member 34. During this movement, the mating guide beam 60 passes into a mating channel or sleeve formed in the female connection member (not shown) in order to assure proper mating alignment. Once the buttons 48 snapably secure into button holes 62 formed in the female connection member 34, the male connection member 32 is securely retained within the female connection member 34.

Figure 5:
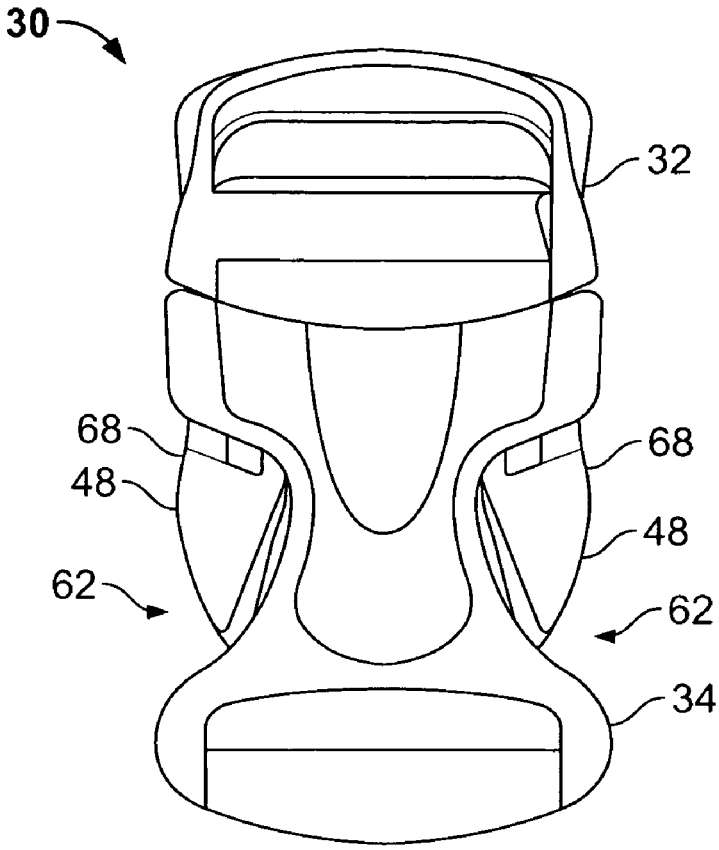
FIG. 5 illustrates a top view of a buckle assembly according to an embodiment of the present invention.
Figure 6:
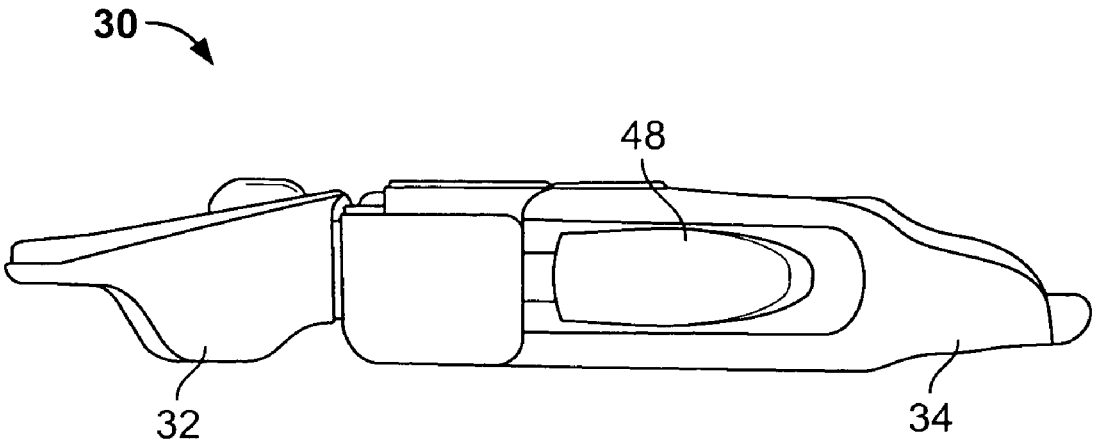
FIG. 6 illustrates a lateral view of a buckle assembly according to an embodiment of the present invention.

FIG. 5 illustrates a top view of the buckle assembly 30. FIG. 6 illustrates a lateral view of the buckle assembly 30. Each lateral portion of the buckle assembly 30 is a mirror image of the other lateral portion. In order to disconnect the male connection member 32 from the female connection member 34, the buttons 48 are squeezed together. As the buttons 48 are squeezed together, the buttons 48 are directed inwardly from the button holes 62. Rounded surfaces 68 of the buttons 48 abut interior walls (not shown) of the female connection member 34. As the buttons 48 are pushed inwardly toward one another, the arms 44 (shown in FIGS. 3 and 4) deflect inwardly. The force stored within the flexed arms 44 is exerted into the interior walls of the female connection member 34 through the rounded surfaces 68 of the buttons 48. The tension stored in the arms 44 tends to cause the arms 44 to return to their original at-rest position. As the arms 44 flex back toward their original positions, the arms 44 release the stored force, thereby causing the male connection member 32 to eject from the female connection member 34.

Figure 7:
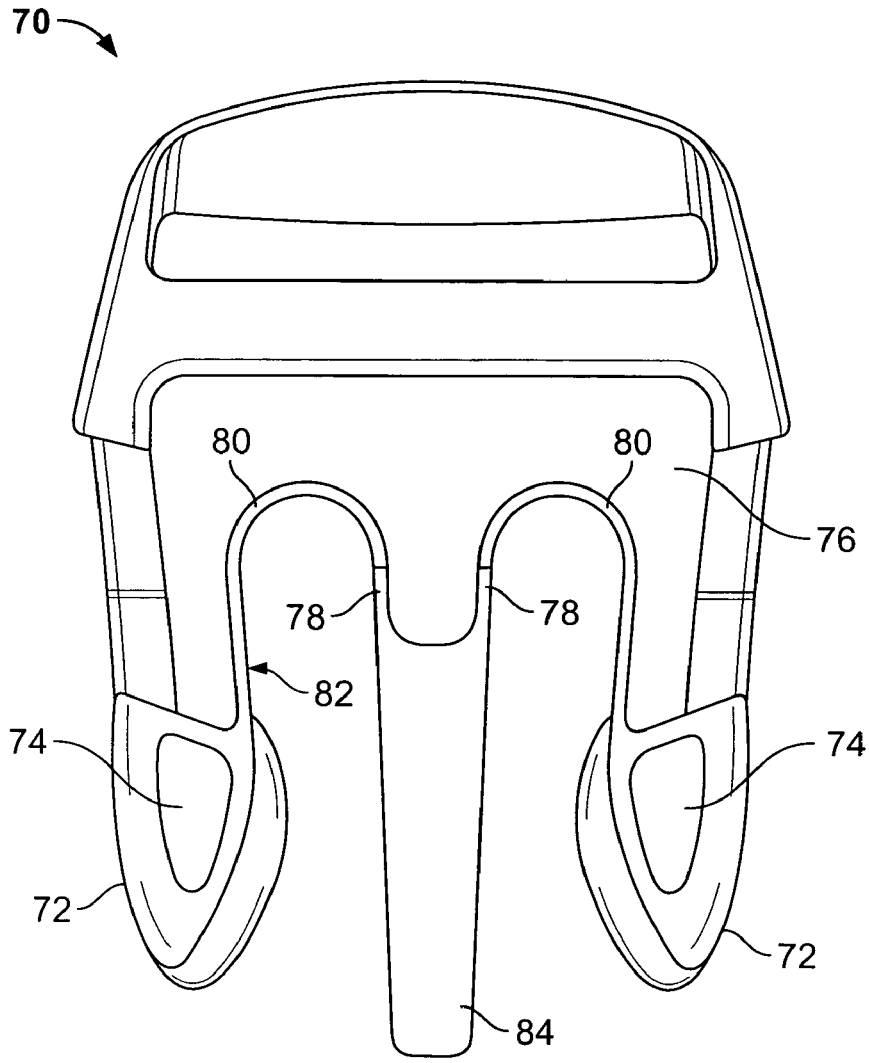
FIG. 7 illustrates a top view of a male connection member according to an embodiment of the present invention.
Figure 8:
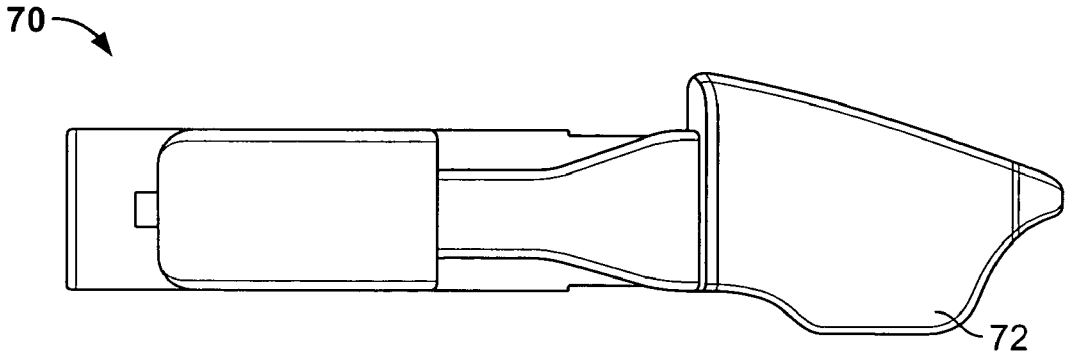
FIG. 8 illustrates a lateral view of a male connection member according to an embodiment of the present invention.
Figure 9:
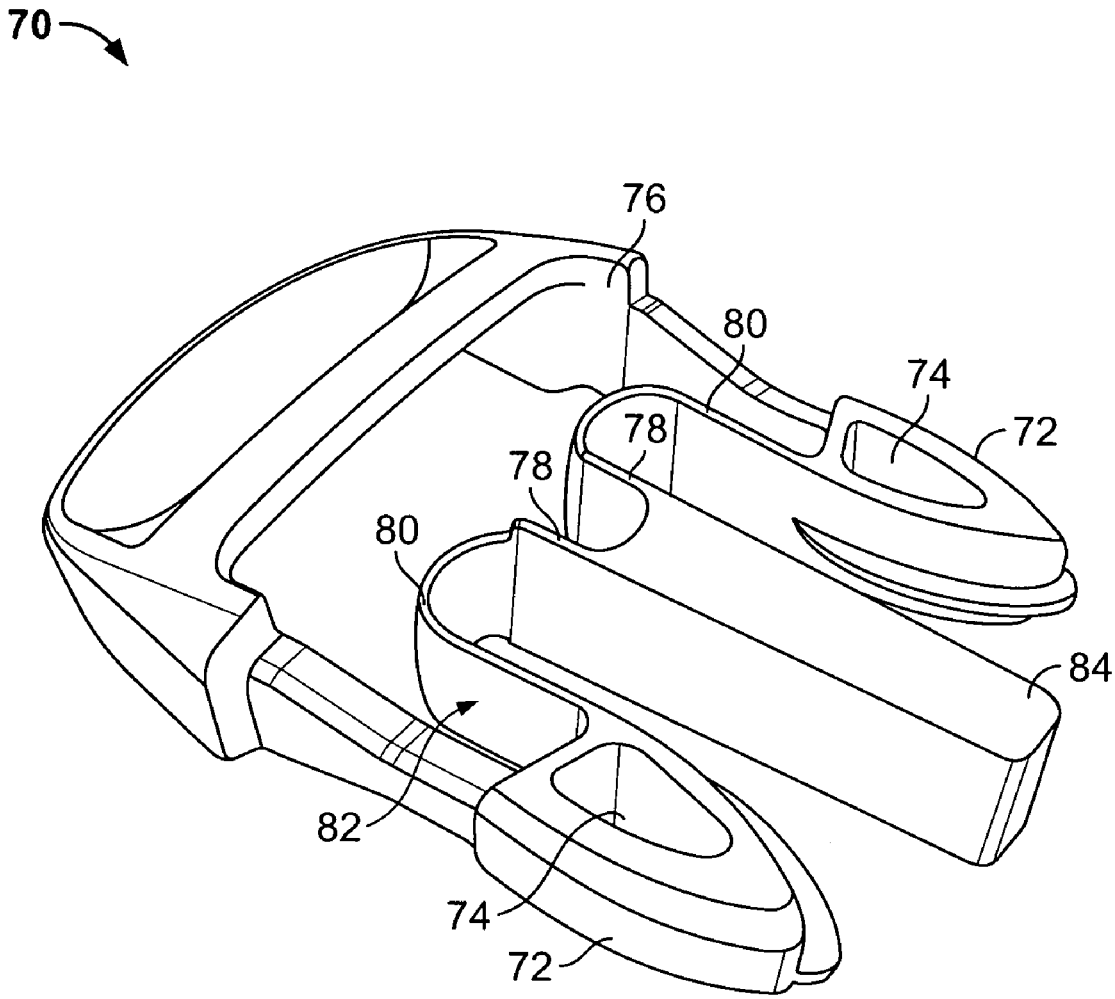
FIG. 9 illustrates a top isometric view of a male connection member according to an embodiment of the present invention.

FIGS. 7, 8, and 9 illustrate top, lateral, and top isometric views of a male connection member 70 according to an embodiment of the present invention. The male connection member 70 is similar to the male connection member 32 (shown in FIGS. 3-6) with some exceptions. First, the buttons 72 include internal cavities 74, which may result from forming dies, or the manufacturing process in general. According to one embodiment, the internal cavity 76 formed in the male connection member 70 can be larger than the internal cavity 53 (shown, e.g., in FIG. 3) of the male connection member 32 (shown in FIGS. 3-6). Thus, the male connection member 70 can use less material than the male connection member 32, which reduces material costs and weight. Further, the bridge 78 is curved, instead of straight. In particular, the curved portions 80 of the floating strut 82 integrally connect to the curved bridge 78, which bends to integrally connect to the mating guide beam 84. As shown in FIGS. 7-9, the floating strut 82 is shaped in the form of a W. Because the bridge 78 is curved, the floating strut 82 offers additional flexibility and resilience in that the curved portions 80 may deflect easier due to the fact that the curved portions 80 do not connect to the bridge 78 at straight, rigid joints. As such, the buttons 72 may be easily squeezed together.

Thus, embodiments of the present invention provide a buckle assembly having mating components that may be easily disconnected. In particular, embodiments of the present invention provide a side-release buckle assembly in which a male connection member may be disconnected from a female connection member using less force as compared to conventional side-release buckle assemblies. The male connection member includes a floating strut member that allows the main pivot points to be closer to the strap bar. Because a rigid strut member is not used with embodiments of the present invention, a simpler male connection member construction having a smaller main body of less material (as compared to a conventional side-release buckle assembly) is possible.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others killed in the art to utilize the invention. The claims are to be construed to include alternative embodiments to the extent permitted by the prior art.

Various features of the invention are set forth in the following claims.

The invention claimed is:

1. A buckle assembly comprising:

a female connection member; and a male connection member configured to mate with said female connection member into a securely connected position, said male connection member comprising:

lateral arms having distal ends, said lateral arms configured to deflect about pivot points, said distal ends configured to be secured within said female connection member;

a flexible and resilient floating strut connecting said lateral arms together;

wherein said lateral arms include buttons at said distal ends, and wherein said floating strut comprises button arms extending from said buttons, said button arms being spaced apart and separate from said lateral arms, said button arms integrally connecting to inwardly-directed curved portions, which in turn integrally connect to a bridge that connects said inwardly-directed curved portions together; and a mating guide beam outwardly extending from said bridge.

2. The buckle assembly of claim 1, wherein said male connection member further comprises a strap bar, said pivot points being proximate said strap bar.

3. The buckle assembly of claim 2, wherein a cavity is defined between said lateral arms, said floating strut, and said strap bar.

4. The buckle assembly of claim 1, wherein said floating strut is U-shaped.

5. The buckle assembly of claim 1, wherein said floating strut is W-shaped.

6. The buckle assembly of claim 1, wherein each of said male and female connection members comprises a strap-receiving channel.

7. The buckle assembly of claim 1, wherein said buttons are configured to be engaged to disconnect said male connection member from said female connection member.

8. The buckle assembly of claim 1, wherein said floating strut spring-biases said lateral arms apart from one another.

9. A male buckle connector configured to securely mate with a female buckle connector, the male buckle connector comprising;

lateral arms having buttons at distal ends, said lateral arms configured to deflect about first pivot points;

a flexible and resilient floating strut connecting said lateral arms together, said floating strut configured to deflect about at least one second pivot point;

wherein said floating strut comprises button arms extending from said buttons, said button arms being spaced apart and separate from said lateral arms, said button arms integrally connecting to inwardly-directed curved portions, which in turn integrally connect to a bridge that connects said inwardly-directed curved portions together, wherein said at least one second pivot point is proximate said curved portions; and a mating guide beam outwardly extending from said bridge.

10. The male buckle connector of claim 9, further comprising a strap bar, said first pivot points being proximate said strap bar.

11. The male buckle connector of claim 10, wherein a cavity is defined between said lateral arms, said flouting strut, and said strap bar.

12. The male buckle connector of claim 9, wherein said floating strut is U-shape.

13. The male buckle connector of claim 9, wherein said floating strut is W-shaped.

14. The male buckle connector of claim 9, further comprising a strap-receiving channel.

15. The male buckle connector of claim 9, wherein said buttons are configured to be engaged to disconnect the male buckle connector from said female buckle connector.

16. The male buckle connector of claim 9, wherein said floating strut spring-biases said lateral arms apart from one another.

17. A buckle assembly comprising:

a first connection member having button openings; and a second connection member configured to mate with said first connection member into a securely connected position, said second connection member comprising:

lateral arms having buttons at distal ends, said lateral arms configured to deflect about first pivot points, said buttons configured to be secured within said button openings;

a strap bar, said first pivot points being proximate said strap bar;

a flexible and resilient floating strut connecting said lateral arms together, said floating strut comprising button arms extending from said buttons, said button arms being spaced apart and separate from said lateral arms, said button arms integrally connecting to inwardly-directed curved portions, which in turn integrally connect to a bridge that connects said inwardly-directed curved portions together, said floating strut configured to deflect about second pivot points being spaced a distance away from said strap bar and closer to said buttons as compared to said first pivot points;

a cavity defined between said lateral arms, said floating strut, and said strap bar; and a mating guide beam outwardly extending from said bridge;

wherein said floating strut is one of a U-shape and a W-shape.

* * * * *